US006133821A

United States Patent [19]

Nabika et al.

[11] Patent Number: 6,133,821

[45] **Date of Patent: *Oct. 17, 2000**

[54] PTC THERMISTOR WITH IMPROVED FLASH PRESSURE RESISTANCE

[75] Inventors: Yasuhiro Nabika; Takeo Haga, both of Shiga, Japan

[73] Assignee: Murata Manufacturing Co., Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/170,882

[22] Filed: Oct. 13, 1998

[30] Foreign Application Priority Data

Oct. 27, 1997 [JP] Japan ..... 9-293090

[51] Int. Cl.[7] ..... H01C 7/10; H01C 7/13

[52] U.S. Cl. ..... 338/22 R; 338/25

[58] Field of Search ..... 338/22 R, 21, 338/25

[56] References Cited

U.S. PATENT DOCUMENTS 4,259,657 3/1981 Ishikawa et al. .
4,904,850 2/1990 Claypool et al. ..... 219/548

FOREIGN PATENT DOCUMENTS 0779630 6/1997 European Pat. Off. .
4-365303 12/1992 Japan .
5-135905 6/1993 Japan .
5-343201 12/1993 Japan .
6-151104 5/1994 Japan .
9-017606 1/1997 Japan .

OTHER PUBLICATIONS

Patent Abstract of Japan 0511446 (no date).
Patent Abstract of Japan 08181004 (no date).
Database WP1; Section Ch, Week 8437; Derwent Publications Ltd., London, GB; Class L03, AN 84–228227; XP002091836 & JP 59 135703 A (no date).

*Primary Examiner*—Lincoln Donovan
*Assistant Examiner*—Richard K. Lee
*Attorney, Agent, or Firm*—Majestic, Parsons, Siebert & Hsue P.C.

[57] ABSTRACT

A PTC thermistor has a disk-shaped main body with electrodes on its main surfaces which are facing mutually away from each other such that, during an initial period after a potential difference is applied between these electrodes, the side surface of the main body has an asymmetric temperature distribution between the electrodes in the direction normal to its main surfaces. The heat emission does not have a peak half-way between the electrodes in the direction of the thickness such that the thermistor has an improved resistance against flash pressure. This may be done by forming the electrodes in different sizes or by providing a non-uniform distribution in specific resistance to the main body such that the heat-emission peak is displaced from the center region between the two main surfaces of the main body.

3 Claims, 2 Drawing Sheets

PTC THERMISTOR WITH IMPROVED FLASH PRESSURE RESISTANCE

BACKGROUND OF THE INVENTION

This invention relates to a thermistor with resistance having a positive temperature coefficient, or a so-called PTC thermistor. In particular, this invention relates to a PTC thermistor with improved resistance against flash pressure.

PTC thermistors are required to have a large resistance against flash pressure when used for protection against an over-current, for demagnetization or in a motor starter. FIGS. 3A and 3B show a typical prior art PTC thermistor 1 having electrodes 6 and 7 individually formed on the mutually oppositely facing main surfaces 3 and 4 of a circular disk-shaped main body 2. Numeral 5 indicates the side surface of this disk-shaped main body 2. FIGS. 4A and 4B show another prior art PTC thermistor 11 which also has electrodes 16 and 17 individually formed on the mutually oppositely facing main surfaces 13 and 14 of a circular disk-shaped main body 12 but is different from the example shown in FIGS. 3A and 3B in that the main body 12 is divided into three regions in the direction of its thickness, that is, a center region 18 and two outer regions 19 and 20 which sandwich it in between, the outer regions 19 and 20 having a higher specific resistance than the inner region 18. Such an prior art PTC thermistor has been disclosed in Japanese Patent Publication Tokkai 9-17606. In FIGS. 4A and 4B, numeral 15 indicates a side surface of the main body 2, extending in the direction of the thickness and connecting the circular peripheries of the two main surfaces 13 and 14.

When a potential difference is applied between the electrodes 6 and 7 of the PTC thermistor 1 shown in FIGS. 3A and 3B, its main body 2 begins to generate heat. During the initial stage of its heat emission, the region of peak heat emission is at the center of the main body 2 in the direction of its thickness. As a result, the temperature distribution inside the main body 2 in the direction of its thickness becomes as shown in FIG. 3C. Thus, a relatively large tensile force is generated and the main body 2 is likely to be damaged if its resistance against flash pressure is not sufficiently strong.

When a potential difference is applied between the electrodes 16 and 17 of the PTC thermistor 11 shown in FIGS. 4A and 4B, on the other hand, two peak heat emission regions appear inside its main body 12 during its initial stage of heat emission. As a result, the temperature distribution inside the main body 12 in the direction of its thickness becomes as shown in FIG. 4C. In other words, the two temperature peaks are reasonably well separated and the overall temperature distribution is better balanced.

In spite of the advantage described above, the PTC thermistor 11 shown in FIGS. 4A and 4B are more troublesome and more costly to manufacture because two different materials must be used to manufacture its main body 12 and an extra step is involved for forming a layered structure.

SUMMARY OF THE INVENTION

It is therefore an object of this invention to provide a PTC thermistor with improved resistance against flash pressure which can be manufactured easily.

A PTC thermistor embodying this invention, with which the above and other objects can be accomplished, may be characterized as being structured similarly to the prior art PTC thermistors 1 and 11 described above to the extent of comprising a disk-shaped main body with electrodes on its main surfaces which are facing mutually away from each other but different therefrom wherein the main body and/or the electrodes are so structured that, during an initial period after a potential difference is applied between these electrodes, the side surface of the main body has an asymmetric temperature distribution between the electrodes in the direction of the thickness of the main body and the peak heat emission does not take place half-way between the electrodes in the direction of the thickness but somewhere significantly closer to one or the other of the main surfaces. In other words, this invention is based on the discovery that it is not necessary to provide a main body having two conveniently separated heat emission peaks displaced away from each other toward the respective main surfaces (as shown in FIGS. 4A and 4B) in order to improve the resistance against flash pressure but is sufficient to displace the heat-emitting peak somewhat in the direction of the thickness.

One method of bringing about such a displacement is to form the electrodes in different sizes. If the main body is a circular disk, for example, one of the electrodes may be formed as a concentric circular disk smaller than the main surface such that there is a gap left around the peripheral edge of the main surface while the other electrode covers the entire area of the other main surface. Alternatively, both electrodes may be formed so as to leave gaps around their circumferences but the widths of the gaps are different. If the electrodes on both main surfaces of the main body are thus different in size, the current density inside the main body is not uniform in the direction of the thickness and this has been found sufficient to displace the heat-emission peak from the plane half-way between the two main surfaces.

Another method is to provide a non-uniform distribution in specific resistance to the main body in the direction of its thickness. The rate of heat emission increases where the specific heat is relatively high. The heat-emission peak can thus be displaced from the center region between the two main surfaces of the main body. As an example, this can be accomplished by forming the main body with two layers having different specific resistances.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1A:
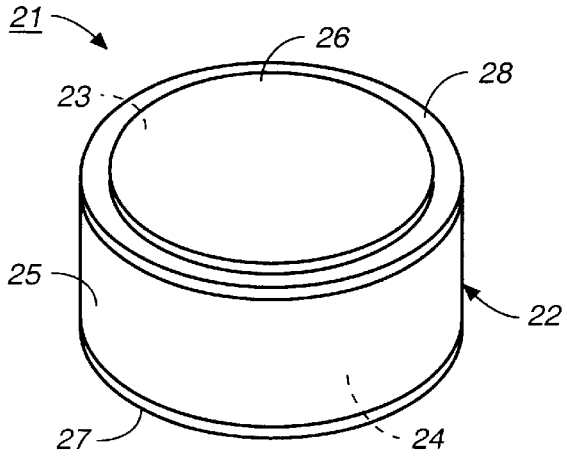
FIGS. 1A and 1B are respectively a diagonal view and a side view of a PTC thermistor according to a first embodiment of this invention.
Figure 1C:
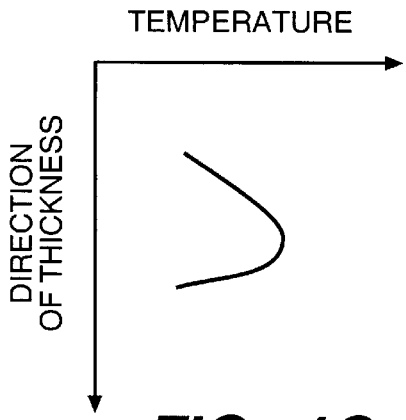
FIG. 1C is a graph of temperature distribution therein at an early stage of its operation.
Figure 1B:
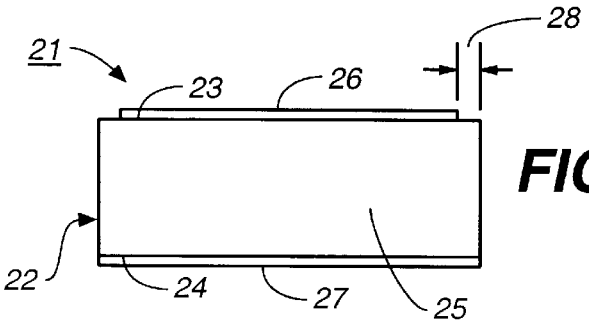

FIGS. 1A and 1B show a PTC thermistor 21 according to a first embodiment of this invention, comprising a circular disk-shaped main body 22 (of a known material for producing PTC thermistors, herein also referred to as "the PTC thermistor main body" or simply as "the main body") and two electrodes 26 and 27 formed thereon. Like the prior art PTC thermistors 1 and 11 described above with reference to FIGS. 3A, 3B, 4A and 4B, the disk-shaped main body 22 according to this embodiment also has two circular main surfaces ("the first main surface 23" and "the second main surface 24") which face oppositely away from each other, and a side surface 25 extends in the direction of its thickness (or "the normal direction" with respect to the main surfaces), connecting the circular peripheral edges of these main surfaces 23 and 24. The two electrodes ("the first electrode 26" and "the second electrode 27") are planar and formed respectively on the main surfaces 23 and 24, for example, by subjecting an ohmic silver material to a firing process. Alternatively, a three-layer structure with Cr, Ni—Cu and Ag may be formed by a dry soldering method.

This embodiment of the invention is characterized in that a gap of a specified width is left between the circular periphery of the first electrode 26 and that of the first main surface 23, the periphery of the first electrode 26 being inwardly retracted from the periphery of the first main surface 23, while the second electrode 27 is formed so as to completely cover the second main surface 24, reaching its periphery.

When a potential difference is applied between the first and second electrodes 26 and 27, the current density on the side surface 25 of the main body 22 is lower towards the first electrode 26 with the gap formed around it than towards the second electrode 27 which totally covers the second main surface 24. As a result, the rate of heat generation is generally higher near the second main surface 24 than near the first main surface 23. Thus, during the initial stage of heating (say, 0.1 second after the potential difference is applied), the temperature distribution inside the main body 22 in the direction of its thickness becomes as shown in FIG. 1C, the peak heat-generating region being shifted from the center towards the second electrode 27 and the temperature distribution becoming asymmetric with respect to the center region in the direction of the thickness. As a result, the resistance of the PTC thermistor 21 against flash pressure is improved.

In order to obtain such a distribution curve, it is not a necessary condition that the second electrode 27 completely cover the second main surface 24. It is sufficient if the distance between the peripheries of the first electrode 26 and the first main surface 23 is different from the distance between the peripheries of the second electrode 27 and the second main surface 24. Even if a gap is formed both around the first electrode 26 and around the second electrode 27, the widths of these gaps need not be uniform. One or both of the electrodes 26 and 27 may be shifted towards the side surface 25.

Figure 2A:
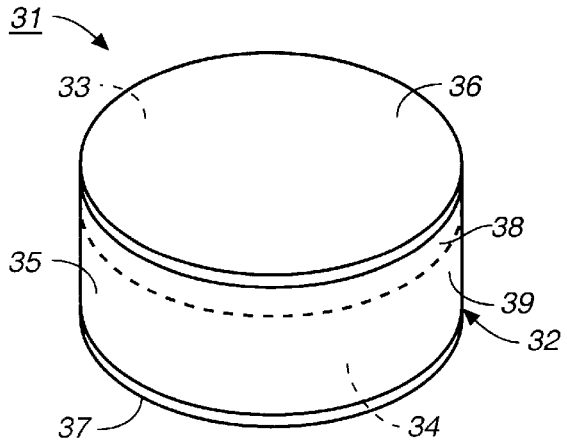
FIGS. 2A and 2B are respectively a diagonal view and a side view of a PTC thermistor according to a second embodiment of this invention.
Figure 2C:
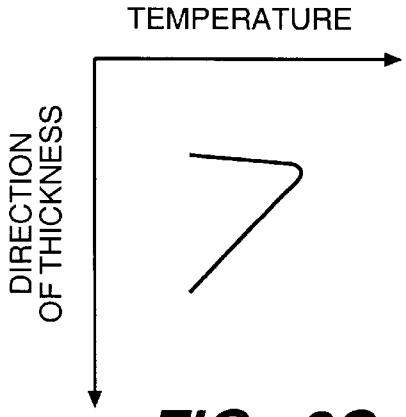
FIG. 2C is a graph of temperature distribution therein at an early stage of its operation.
Figure 2B:
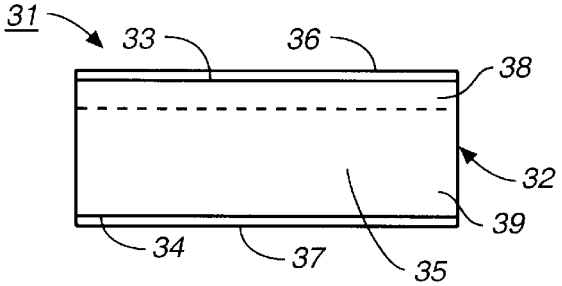
Figure 3A:
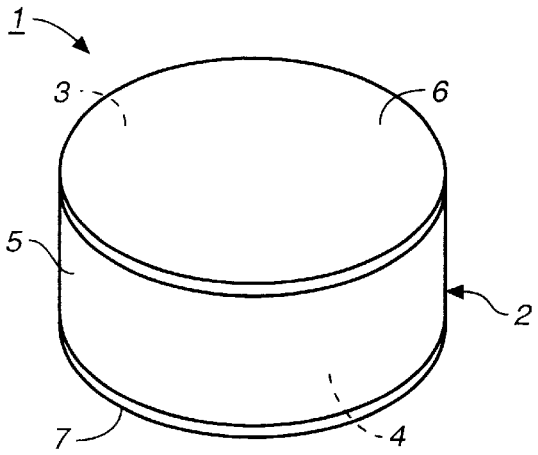
FIG. 3A (PRIOR ART)
FIGS. 3A and 3B are respectively a diagonal view and a side view of a prior art PTC thermistor.
Figure 3C:
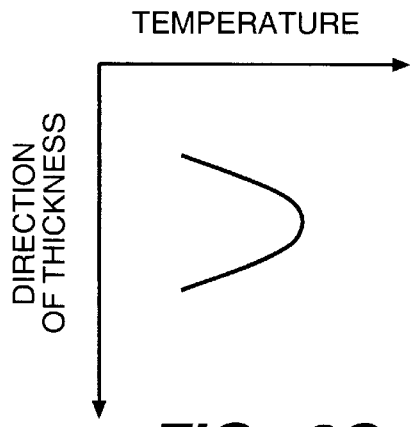
FIG. 3C (PRIOR ART)
FIG. 3C is a graph of temperature distribution therein at an early stage of its operation.
Figure 3B:
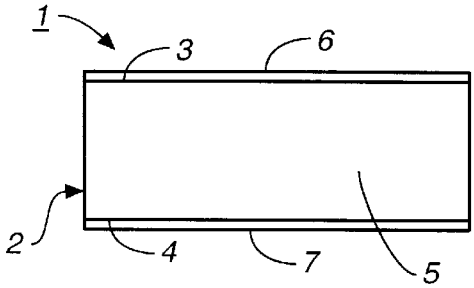
FIG. 3B (PRIOR ART)
Figure 4A:
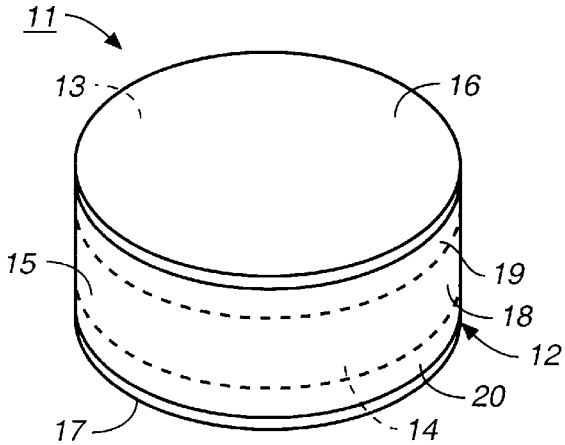
FIG. 4A (PRIOR ART)
FIGS. 4A and 4B are respectively a diagonal view and a side view of another prior art PTC thermistor.
Figure 4C:
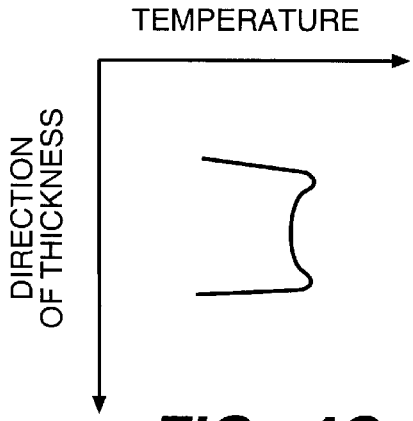
FIG. 4C (PRIOR ART)
FIG. 4C is a graph of temperature distribution therein at an early stage of its operation.
Figure 4B:
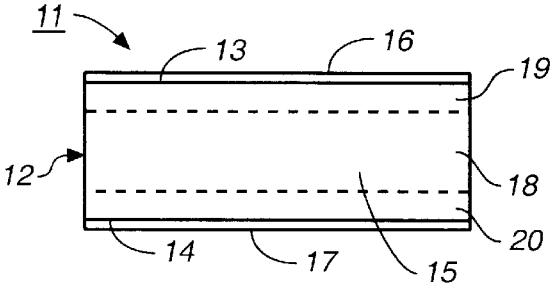
FIG. 4B (PRIOR ART)

FIGS. 2A and 2B show another PTC thermistor 31 according to a second embodiment of this invention, also comprising a circular disk-shaped main body 32 and two electrodes 36 and 37 formed thereon. This disk-shaped main body 32 also has two circular main surfaces ("the first main surface 33" and "the second main surface 34") which face oppositely away from each other, and a side surface 35 extends in the direction of its thickness, connecting the circular peripheral edges of these main surfaces 33 and 34. The two electrodes ("the first electrode 36" and "the second electrode 37") are planar and formed respectively on the main surfaces 33 and 34. These electrodes 36 and 37 may be formed with same materials and in the same manner as the electrodes 26 and 27 described above.

This embodiment of the invention is characterized in that the main body 32 is divided into two regions ("the first region 38" and "the second region 39") in the direction of its thickness, having different specific resistances. Let us assume that the specific resistance of the material for the first region 38 closer to the first main surface 33 is higher than that of the material for the second region 39 closer to the second main surface 34.

When a potential difference is applied between the first and second electrodes 36 and 37, the rate of heat generation in the first region 38 is higher than that in the second region 39. Thus, during the initial stage of heating (say, 0.1 second after the potential difference is applied), the temperature distribution inside the main body 32 in the direction of its thickness becomes as shown in FIG. 2C, the peak heat-generating region being shifted from the center in the direction of thickness towards the first region 38 and the temperature distribution becoming asymmetric with respect to the center region in the direction of thickness. As a result, the resistance of the PTC thermistor 21 against flash pressure is improved also by this example.

Although the invention has been described above with reference to only two embodiments, these embodiments are not intended to limit the scope of the invention. Many modifications and variations are possible within the scope of the invention. For example, the first region 38 and the second region 39 need not have a distinct boundary. The main body 32 may be structured such that the specific resistance changes continuously from one main surface to the other. The characteristics of both the first and second embodiments may be combined together, providing gaps of different widths around the first and second electrodes on the first and second main surfaces and also providing a non-uniform distribution in the specific resistance of the material of the main body.

Next, the invention will be described by way of tests which were conducted to ascertain the effects of the invention.

In order to obtain samples according to Test Example No. 1 (PTC thermistors 21 according to the first embodiment of this invention), Test Example No. 2 (PTC thermistors 31 according to the second embodiment of this invention), Comparison Example No. 1 (prior art PTC thermistors 11 described above), and Comparison Example No. 2 (prior art PTC thermistors 21 described above), use was made of a thermistor material having $BaTiO_3$ as its main component with Curie point 120° C. and resistance 23Ω at normal temperatures. For all samples, the main body was a disk of diameter 8.2 mm and thickness 3 mm. For Test Example No. 1, the width of the gap around the first electrode 26 was 0.5 mm. For the high-resistance regions for Test Example No. 2 and Comparison Example No. 2, resin beads were added to the aforementioned material for the thermistor body and pores were created by a firing process. For Test Example No. 2, the thickness of the first region 38 with higher resistance was 0.6 mm. For Comparison Example No. 2, the thickness of each of the outer regions with higher resistance was 0.6 mm.

These samples were used to test their resistance against flash pressure. The results are shown in Table 1.

TABLE 1

| | Minimum | Average |
|---|---|---|
| Test Example No. 1 | 560 V | 650 V |
| Test Example No. 2 | 560 V | 650 V |
| Comparison Example No. 1 | 355 V | 510 V |
| Comparison Example No. 2 | 560 V | 650 V |

This shows that the samples according to the first and second embodiments of this invention are equally capable of resisting flash pressure as Comparison Example No. 2, having much better results than Comparison Example 1.

What is claimed is:

1. A PTC thermistor comprising:

a PTC thermistor main body having a pair of first main surface and second main surface and a side surface connecting said pair of main surfaces and extending in a normal direction to said main surfaces;

a first electrode on said first main surface; and a second electrode on said second main surface;

wherein said main body is structured so as to have specific resistance which varies non-symmetrically in said normal direction between said surface such that during an initial period after a potential difference is applied between said first electrode and said second electrode said side surface has a temperature distribution which is asymmetric in said normal direction between said first main surface and said second main surface and that said side surface has a peak heat-emitting region which is significantly closer to either one than the other of said pair of main surfaces; and wherein said PTC thermistor has a significantly larger resistance against flash pressure than if said temperature distribution were not asymmetric.

2. The PTC thermistor of claim 1 wherein said PTC thermistor main body is divided into two regions in said normal direction, said two regions having different specific resistances.

3. The PTC thermistor of claim 1 wherein said main body is structured such that said side surface has a temperature distribution with a single peak during said initial period after a potential difference is applied between said first electrode and said second electrode.

* * * * *